US008226741B2

(12) United States Patent
Shekhter et al.

(10) Patent No.: US 8,226,741 B2
(45) Date of Patent: Jul. 24, 2012

(54) PROCESS FOR PREPARING METAL POWDERS HAVING LOW OXYGEN CONTENT, POWDERS SO-PRODUCED AND USES THEREOF

(75) Inventors: Leonid N. Shekhter, Ashland, MA (US); Steven A. Miller, Canton, MA (US); Leah F. Haywiser, Arlington, MA (US); Rong-Chein Richard Wu, Chelmsford, MA (US)

(73) Assignee: H.C. Starck, Inc., Newton, MA (US)

( * ) Notice: Subject to any disclaimer, the term of this patent is extended or adjusted under 35 U.S.C. 154(b) by 491 days.

(21) Appl. No.: 12/444,263

(22) PCT Filed: Oct. 3, 2007

(86) PCT No.: PCT/US2007/080282

§ 371 (c)(1),
(2), (4) Date: Oct. 5, 2009

(87) PCT Pub. No.: WO2008/042947

PCT Pub. Date: Oct. 4, 2008

(65) Prior Publication Data

US 2010/0272889 A1 Oct. 28, 2010

Related U.S. Application Data

(63) Continuation of application No. 11/542,055, filed on Oct. 3, 2006, now abandoned.

(51) Int. Cl.
*B22F 1/00* (2006.01)

(52) U.S. Cl. ..... 75/346; 75/369

(58) Field of Classification Search ..... None
See application file for complete search history.

(56) References Cited

U.S. PATENT DOCUMENTS

| | | | |
|---|---|---|---|
| 3,436,299 | A | 4/1969 | Halek |
| 3,990,784 | A | 11/1976 | Gelber |
| 4,011,981 | A | 3/1977 | Danna et al. |
| 4,073,427 | A | 2/1978 | Keifert et al. |
| 4,140,172 | A | 2/1979 | Corey |
| 4,202,932 | A | 5/1980 | Chen et al. |
| 4,291,104 | A | 9/1981 | Keifert |
| 4,459,062 | A | 7/1984 | Siebert |
| 4,483,819 | A | 11/1984 | Albrecht et al. |
| 4,508,563 | A | 4/1985 | Bernard et al. |
| 4,510,171 | A | 4/1985 | Siebert |
| 4,537,641 | A | 8/1985 | Albrecht et al. |
| 4,722,756 | A | 2/1988 | Hard |
| 4,731,111 | A | 3/1988 | Kopatz et al. |
| 4,818,629 | A | 4/1989 | Jenstrom et al. |
| 4,915,745 | A | 4/1990 | Pollock et al. |
| 4,964,906 | A | 10/1990 | Fife |
| 5,061,527 | A | 10/1991 | Watanabe et al. |
| 5,091,244 | A | 2/1992 | Biornard |
| 5,147,125 | A | 9/1992 | Austin |
| 5,242,481 | A | 9/1993 | Kumar |
| 5,270,858 | A | 12/1993 | Dickey |
| 5,271,965 | A | 12/1993 | Browning |
| 5,302,414 | A | 4/1994 | Alkhimov et al. |
| 5,305,946 | A | 4/1994 | Heilmann |
| 5,330,798 | A | 7/1994 | Browning |
| 5,580,516 | A | 12/1996 | Kumar |
| 5,612,254 | A | 3/1997 | Mu et al. |
| 5,679,473 | A | 10/1997 | Murayama et al. |
| 5,693,203 | A | 12/1997 | Ohhashi et al. |
| 5,795,626 | A | 8/1998 | Gabel et al. |
| 5,859,654 | A | 1/1999 | Radke et al. |
| 5,954,856 | A | 9/1999 | Pathare et al. |
| 5,972,065 | A | 10/1999 | Dunn et al. |
| 5,993,513 | A | 11/1999 | Fife |
| 6,030,577 | A | 2/2000 | Commandeur et al. |
| 6,136,062 | A | 10/2000 | Loffelholz et al. |
| 6,139,913 | A | 10/2000 | Van Steenkiste et al. |
| 6,171,363 | B1 | 1/2001 | Shekhter et al. |
| 6,189,663 | B1 | 2/2001 | Smith et al. |
| 6,197,082 | B1 | 3/2001 | Dorvel et al. |

(Continued)

FOREIGN PATENT DOCUMENTS

DE 10253794 A1 6/2004

(Continued)

OTHER PUBLICATIONS

Kosarev et al., "Recently Patent Facilities and Applications in Cold Spray Engineering," Recent Patents on Engineering, vol. 1 pp. 35-42 (2007).

(Continued)

*Primary Examiner* — George Wyszomierski
(74) *Attorney, Agent, or Firm* — Bingham McCutchen LLP

(57) ABSTRACT

The present invention is directed to a process for the preparation of a metal powder having a purity at least as high as the starting powder and having an oxygen content of 10 ppm or less comprising heating said metal powder containing oxygen in the form of an oxide, with the total oxygen content being from 50 to 3000 ppmf in an inert atmosphere at a pressure of from 1 bar to $10^{-7}$ to a temperature at which the oxide of the metal powder becomes thermodynamically unstable and removing the resulting oxygen via volatilization. The metal powder is preferably selected from the group consisting of tantalum, niobium, molybdenum, hafnium, zirconium, titanium, vanadium, rhenium and tungsten. The invention also relates to the powders produced by the process and the use of such powders in a cold spray process.

30 Claims, No Drawings

U.S. PATENT DOCUMENTS 6,238,456 B1 5/2001 Wolf et al.
6,245,390 B1 6/2001 Baranovski et al.
6,258,402 B1 7/2001 Hussary et al.
6,261,337 B1 7/2001 Kumar
6,328,927 B1 12/2001 Lo et al.
6,331,233 B1 12/2001 Turner
6,408,928 B1 6/2002 Heinrich et al.
6,444,259 B1 9/2002 Subramanian et al.
6,482,743 B1 11/2002 Sato
6,491,208 B2 12/2002 James et al.
6,502,767 B2 1/2003 Kay et al.
6,521,173 B2 2/2003 Kumar et al.
6,558,447 B1 5/2003 Shekhter et al.
6,589,311 B1 7/2003 Han et al.
6,623,796 B1 9/2003 Van Steenkiste
6,669,782 B1 12/2003 Thakur
6,722,584 B2 4/2004 Kay et al.
6,723,379 B2 4/2004 Stark
6,743,468 B2 6/2004 Fuller et al.
6,749,002 B2 6/2004 Grinberg et al.
6,759,085 B2 7/2004 Muehlberger
6,770,154 B2 8/2004 Koenigsmann et al.
6,773,969 B2 8/2004 Lee et al.
6,780,458 B2 8/2004 Seth et al.
6,855,236 B2 2/2005 Sato et al.
6,872,425 B2 3/2005 Kaufold et al.
6,872,427 B2 3/2005 Van Steenkiste et al.
6,896,933 B2 5/2005 Van Steenkiste et al.
6,905,728 B1 6/2005 Hu et al.
6,911,124 B2 6/2005 Tang et al.
6,915,964 B2 7/2005 Tapphorn et al.
6,919,275 B2 7/2005 Chiang et al.
6,924,974 B2 8/2005 Stark
6,953,742 B2 10/2005 Chen et al.
6,962,407 B2 11/2005 Yamamoto et al.
7,053,294 B2 5/2006 Tuttle et al.
7,067,197 B2 6/2006 Michaluk et al.
7,081,148 B2 7/2006 Koenigsmann et al.
7,101,447 B2 9/2006 Turner
7,108,893 B2 9/2006 Van Steenkiste et al.
7,128,988 B2 10/2006 Lambeth
7,143,967 B2 12/2006 Heinrich et al.
7,163,715 B1 1/2007 Kramer
7,164,205 B2 1/2007 Yamaji et al.
7,170,915 B2 1/2007 McDonald
7,175,802 B2 2/2007 Sandlin et al.
7,178,744 B2 2/2007 Tapphorn et al.
7,183,206 B2 2/2007 Shepard
7,192,623 B2 3/2007 Andre et al.
7,208,230 B2 4/2007 Ackerman et al.
7,244,466 B2 7/2007 Van Steenkiste et al.
7,278,353 B2 10/2007 Langan et al.
7,335,341 B2 2/2008 Van Steenkiste et al.
7,399,335 B2 7/2008 Shekhter et al.
7,402,277 B2 7/2008 Ayer et al.
7,479,299 B2 1/2009 Raybould et al.
7,514,122 B2 4/2009 Kramer
7,582,846 B2 9/2009 Molz et al.
7,618,500 B2 11/2009 Farmer et al.
7,670,406 B2 3/2010 Belashchenko
7,910,051 B2 3/2011 Zimmermann et al.
8,002,169 B2 8/2011 Miller et al.
2002/0112789 A1 8/2002 Jepson et al.
2002/0112955 A1 8/2002 Aimone et al.
2003/0023132 A1 1/2003 Melvin et al.
2003/0190413 A1 10/2003 Van Steenkiste et al.
2003/0219542 A1 11/2003 Ewasyshyn et al.
2003/0232132 A1 12/2003 Muehlberger
2004/0037954 A1 2/2004 Heinrich et al.
2004/0065546 A1 4/2004 Michaluk et al.
2004/0076807 A1 4/2004 Grinberg et al.
2004/0107798 A1* 6/2004 Hirata et al. ..... 75/331
2004/0126499 A1 7/2004 Heinrich et al.
2004/0202885 A1 10/2004 Seth et al.
2005/0084701 A1 4/2005 Slattery
2005/0120957 A1 6/2005 Kowalsky et al.
2005/0142021 A1 6/2005 Aimone et al.
2005/0147742 A1 7/2005 Kleshock et al.
2005/0155856 A1 7/2005 Oda
2005/0220995 A1 10/2005 Hu et al.
2005/0252450 A1 11/2005 Kowalsky et al.
2006/0021870 A1 2/2006 Tsai et al.
2006/0027687 A1 2/2006 Heinrich et al.
2006/0032735 A1 2/2006 Aimone et al.
2006/0042728 A1 3/2006 Lemon et al.
2006/0045785 A1 3/2006 Hu et al.
2006/0090593 A1 5/2006 Liu
2006/0121187 A1 6/2006 Haynes et al.
2006/0251872 A1 11/2006 Wang et al.
2007/0116886 A1 5/2007 Refke et al.
2007/0116890 A1 5/2007 Adams et al.
2007/0172378 A1 7/2007 Shibuya et al.
2007/0196570 A1 8/2007 Gentsch et al.
2008/0028459 A1 1/2008 Suh et al.
2008/0078268 A1 4/2008 Shekhter et al.
2008/0145688 A1 6/2008 Miller et al.
2008/0171215 A1 7/2008 Kumar et al.
2008/0216602 A1 9/2008 Zimmermann et al.
2008/0271779 A1 11/2008 Miller et al.
2009/0004379 A1 1/2009 Deng et al.
2009/0239754 A1 9/2009 Kruger et al.
2009/0291851 A1 11/2009 Bohn et al.
2010/0015467 A1 1/2010 Zimmermann et al.
2010/0055487 A1 3/2010 Zimmermann et al.
2010/0061876 A1 3/2010 Miller et al.
2010/0084052 A1 4/2010 Farmer et al.
2010/0086800 A1 4/2010 Miller et al.
2010/0136242 A1 6/2010 Kay et al.
2010/0172789 A1 7/2010 Calla et al.
2010/0189910 A1 7/2010 Belashchenko et al.
2010/0246774 A1 9/2010 Lathrop
2010/0272889 A1 10/2010 Shekhter et al.
2011/0132534 A1 6/2011 Miller et al.

FOREIGN PATENT DOCUMENTS

EP 0074803 A1 3/1983
EP 0484533 A1 5/1992
EP 0774315 A2 5/1997
EP 1 066 899 A2 1/2001
EP 1138420 A2 10/2001
EP 1350861 A1 10/2003
EP 1382720 A2 1/2004
EP 1398394 3/2004
EP 1413642 A1 4/2004
EP 1452622 9/2004
EP 1715080 10/2006
GB 2 121 441 A 12/1983
GB 2394479 A 4/2004
JP 54067198 5/1979
JP 3197640 8/1991
JP 06346232 A 12/1994
JP 11269639 10/1999
JP 01/131767 5/2001
JP 03/301278 10/2003
RU 2166421 C1 5/2001
WO WO-9837249 8/1998
WO WO-0112364 A1 2/2001
WO WO-02064287 A2 8/2002
WO WO-02/070765 9/2002
WO WO-03062491 A2 7/2003
WO WO-03106051 A1 12/2003
WO WO-2004074540 A1 9/2004
WO WO-2005073418 A1 8/2005
WO WO-2005/079209 9/2005
WO WO-2006117145 A2 11/2006
WO WO-2007/001441 1/2007
WO WO-2008/063891 5/2008
WO WO-2008/089188 A1 7/2008

OTHER PUBLICATIONS

Examination Report in European Patent Application No. 07843733.2, mailed Nov. 30, 2010 (9 pages).
English Translation of Office Action mailed Feb. 23, 2011 for Chinese Patent Application No. 200880023411.5 (7 pages).
Morito F et al: Preparation and characterization of sintered Mo-Re alloys. V. 3, No. 7 part 1, Jun. 8, 1993, pp. 553-556.

"Cold Gas Dynamic Spray CGSM Apparatus," Tev Tech LLC, available at: http://www.tevtechllc.com/cold_gas.html (accessed Dec. 14, 2009).
"Cold Spray Process," Handbook of Thermal Spray Technology, ASM International, Sep. 2004, pp. 77-84.
Ajdelsztajn et al., "Synthesis and Mechanical Properties of Nanocrytalline Ni Coatings Producted by Cold Gas Dynamic Spraying," 201 Surface and Coatings Tech. 3-4, pp. 1166-1172 (Oct. 2006).
Examination Report in European Patent Application No. 09172234.8, mailed Jun. 16, 2010 (3 pages).
Gärtner et al., "The Cold Spray Process and its Potential for Industrial Applications," 15 J. of Thermal Sprsy Tech. 2, pp. 223-232 (Jun. 2006).
Hall et al., "The Effect of a Simple Annealing Heat Treatment on the Mechanical Properties of Cold-Sprayed Aluminum," 15 J. of Thermal Spray Tech. 2, pp. 233-238 (Jun. 2006.).
Hall et al., "Preparation of Aluminum Coatings Containing Homogeneous Nanocrystalline Microstructures Using the Cold Spray Process," JTTEES 17:352-359, Sep. 2008.
IPRP in International Patent Application No. PCT/EP2006/003967, dated Nov. 6, 2007 (15 pages).
IPRP in International Patent Application No. PCT/US2008/062434, dated Nov. 10, 2009 (21 pages).
IPRP in International Patent Application No. PCT/EP2006/003969, mailed dated Nov. 6, 2007 (13 pages).
International Search Report and Written Opinion in International Patent Application No. PCT/US2007/087214, mailed Mar. 23, 2009 (13 pages).
IPRP in International Patent Application No. PCT/US2007/081200, dated Sep. 1, 2009 (17 pages).
IPRP in International Patent Application No. PCT/US2007/080282, dated Apr. 7, 2009 (15 pages).
Irissou et al., "Review on Cold Spray Process and Technology: Part I—Intellectual Property," 17 J. of Thermal Spray Tech. 4, pp. 495-516 (Dec. 2008).
Karthikeyan, "Cold Spray Technology: International Status and USA Efforts," ASB Industries, Inc. (Dec. 2004).
Li et al., "Effect of Annealing Treatment on the Microstructure and Properties of Cold-Sprayed Cu Coating," 15 J. of Thermal Spray Tech. 2, pp. 206-211 (Jun. 2006).
Marx et al., "Cold Spraying—Innovative Layers for New Applications," 15 J. of Thermal Spray Tech. 2, pp. 177-183 (Jun. 2006).
Search Report in European Patent Application No. 09172234.8, dated Jan. 29, 2010 (7 pages).
Stoltenhoff et al., "An Analysis of the Cold Spray Process and its Coatings," 11 J. of Thermal Spray Tech. 4, pp. 542-550 (Dec. 2002).
Van Steenkiste et al., "Analysis of Tantalum Coatings Produced by the Kinetic Spray Process," 13 J. of Thermal Spray Tech. 2, pp. 265-273 (Jun. 2004).

* cited by examiner

PROCESS FOR PREPARING METAL POWDERS HAVING LOW OXYGEN CONTENT, POWDERS SO-PRODUCED AND USES THEREOF

CROSS-REFERENCE TO RELATED APPLICATIONS

This application is a national stage application (under 35 U.S.C. §371) of PCT/US2007/80282, filed Oct. 3, 2007, which claims benefit of U.S. application Ser. No. 11/542,055, filed Oct. 3, 2006.

BACKGROUND OF THE INVENTION

Passive oxide layers are inherent to all metal powders. In general, the presence of such oxides has an adverse effect on one or more of the properties of the products made from such powders.

For example, due to the high melting point of tantalum, its purification method yields a metal powder. When exposed to air, tantalum oxidizes and forms an oxide layer, which protects it from further oxidation. In order to make metal parts, this powder must be consolidated to solid form. Due to the inherent stability of this oxide layer, when pressed and sintered into a powder metallurgy form, the oxygen is conserved, yielding a lower quality product. Therefore the oxygen removal becomes a primary objective for tantalum refining.

The operation of oxygen removal is called deoxidation. There is quite a bit of art teaching various ways of removing oxygen. One way to avoid this oxygen is to electron beam melt the powder, vaporizing the oxygen, resulting in an ingot with only the ingot's passive layer of oxygen.

A second known method for removal of oxygen from tantalum is using another element to reduce $Ta_2O_5$. One element that can be used is carbon (see, e.g., U.S. Pat. No. 6,197,082). However, since excess carbon is used for reduction, tantalum carbides result as a contaminant. U.S. Pat. No. 4,537,641 suggests using magnesium, calcium, or aluminum as the reductant (see also U.S. Pat. Nos. 5,954,856 and 6,136,062). These metals can be then leached out of the tantalum with water and diluted mineral acid. U.S. Pat. Nos. 6,261,337, 5,580,516 and 5,242,481 suggest this method for use on low surface area powders, which are used in the manufacture of solid tantalum parts. The byproduct of this process is a layer of MgO on the surface of the tantalum powder. As such it is necessary to expose this powder to air and water during the leaching and drying processes, creating the passive oxide layer. Another potential contaminant, which may result during this process, is magnesium. Magnesium tantalates are stable enough to survive the pressing and sintering processes that yield solid tantalum parts.

European Patent 1,066,899 suggests purifying tantalum powder in thermal plasma. The process was carried out at atmospheric pressure, at the temperatures exceeding the melting point of tantalum in the presence of hydrogen. The resulting powder had spherical morphology and the oxygen concentration as low as 86 ppm.

A more recent development for the removal of oxygen from tantalum is the use of atomic hydrogen as described in U.S. patent application Ser. No. 11/085,876, filed on Mar. 22, 2005. This process requires significant hydrogen excess and is thermodynamically favorable in a relatively narrow temperature range. Theoretically this process is capable of producing very low oxygen powder.

Other techniques for reducing the oxygen content of tantalum are described in U.S. Pat. No. 4,508,563 (contacting tantalum with an alkali metal halide), U.S. Pat. No. 4,722,756 (heating the tantalum under a hydrogen atmosphere in the presence of an oxygen-active metal), U.S. Pat. No. 4,964,906 (heating the tantalum under a hydrogen atmosphere in the presence of a tantalum getter metal having an initial oxygen content lower than the tantalum), U.S. Pat. No. 5,972,065 (plasma arc melting using a gas mixture of helium and hydrogen), and U.S. Pat. No. 5,993.513 (leaching a deoxidized valve metal in an acid leach solution).

Other techniques for reducing the oxygen content in other metals are also known. See, e.g., U.S. Pat. Nos. 6,171,363, 6,328,927, 6,521,173, 6,558,447 and 7,067,197.

Cold spray technology is the process by which materials are deposited as a solid onto a substrate without melting. During the cold spray process, the coating particles are typically heated by carrier gas to only a few hundred degrees Celsius, and are traveling at a supersonic velocity typically in the range of 500 to 1500 meters per second prior to impact with the substrate.

The ability to cold spray different materials is determined by their ductility, the measure of a material's ability to undergo appreciable plastic deformation. The more ductile the raw materials, the better the adhesion attained during the cold-spray process due to its ability to deform.

Different metals have different plastic properties, soft metals, with excellent ductility characteristics, therefore have been used in the cold spray technology, such as copper, iron, nickel, and cobalt as well as some composites and ceramics.

In the family of refractory metals, currently only tantalum and niobium are used, as they are the softest of the refractory metals. Other refractory metals such as molybdenum, hafnium, zirconium, and particularly tungsten are considered brittle, and therefore cannot plastically deform and adhere upon impact during cold spray.

Metals with body centered cubic (BCC) and hexagonal close-packed (HCP) structures exhibit what is called a ductile-to-brittle transition temperature (DBTT). This is defined as the transition from ductile to brittle behavior with a decrease in temperature. The refractory metals, which perform poorly when cold-sprayed, exhibit a higher DBTT. The DBTT, in metals, can be impacted by its purity. Oxygen and carbon are notoriously deleterious to the ductility. Due to their surface area and affinity for oxygen and carbon, these elements tend to be particularly prevalent impurities in metal powders. Since the cold-spray process requires metals powders as a raw material, it makes the use of high DBTT refractory metals prohibitive, with the exception of tantalum and niobium, which have lower DBTT.

DESCRIPTION OF THE INVENTION

The present invention is directed to the discovery that the oxygen content can be drastically reduced by creating conditions at which the refractory oxide species become thermodynamically unstable, and removed by volatilization. The main challenge was to find the thermodynamic parameters (temperature and total pressure) at which the oxide species became unstable and volatilize while the metal species will continue to stay in the condensed phase.

More particularly, the present invention is broadly directed to a process for the preparation of a metal powder having a purity of at least as high as the starting powder and having an oxygen content of 10 ppm or less comprising heating the metal powder containing oxygen in the form of an oxide, with the total oxygen content being from 50 to 3000 ppm, in an inert atmosphere at a pressure of from 1 bar to $10^{-7}$ to a temperature at which the oxide of the metal powder becomes thermodynamically unstable and removing the resulting oxygen via volatilization. The process has the additional advantage of significantly reducing and/or removing any metallic impurities having boiling points lower than that which the oxide of the metal powder becomes thermodynamically unstable.

The metal powder is preferably selected from the group consisting of tantalum, niobium, molybdenum, hafnium, zirconium, titanium, vanadium, rhenium and tungsten.

The inert atmosphere can be substantially any "inert" gas, such as argon, helium, neon, krypton or xenon.

When the metal powder is tantalum, such powder is heated in an inert gas atmosphere at a pressure of from 1 bar to $10^{-7}$ bar and a temperature of from about 1700° C. to about 3800° C. The resultant unpassivated powder has a purity of at least as high as the starting powder, and preferably at least 99.9%, a surface area of from about 100 $cm^2/g$ to about 10,000 $cm^2/g$, an oxygen content of 10 ppm or less, a hydrogen content of 1 ppm or less, a magnesium content of 1 ppm or less, an alkali metal content of 1 ppm or less, and a combined iron plus nickel plus chromium content of 1 ppm or less. As noted above, the process has the advantage of significantly reducing any metallic impurities (such as alkali metals, magnesium, iron, nickel and chromium) having boiling points lower than the temperature at which the tantalum oxide becomes thermodynamically unstable.

When the metal powder is niobium, such powder is heated in an inert gas atmosphere at a pressure of from $10^{-3}$ bar to $10^{-7}$ bar and a temperature of from about 1750° C. to about 3850° C. The resultant unpassivated powder has a purity of at least as high as the starting powder, a surface area of from about 100 $cm^2/g$ to about 10,000 $cm^2/g$, an oxygen content of 10 ppm or less, a hydrogen content of 1 ppm or less, a magnesium content of 1 ppm or less, an alkali metal content of 1 ppm or less, and a combined iron plus nickel plus chromium content of 1 ppm or less.

When the metal powder is tungsten, such powder is heated in an inert gas atmosphere at a pressure of from 1 bar to $10^{-7}$ bar and a temperature of from about 1200° C. to about 1800° C. The resultant unpassivated powder has a purity of at least of as high as the starting powder, a surface area of from about 100 $cm^2/g$ to about 10,000 $cm^2/g$, an oxygen content of 5 ppm or less, a carbon content of 5 ppm or less and a hydrogen content of 1 ppm or less.

When the metal powder is molybdenum, such powder is heated in an inert gas atmosphere at a pressure of from 1 bar to $10^{-7}$ bar and a temperature of from about 1450° C. to about 2300° C. The resultant unpassivated powder has a purity of at least as high as the starting powder, a surface area of from about 100 $cm^2/g$ to about 10,000 $cm^2/g$, an oxygen content of 10 ppm or less and a hydrogen content of 1 ppm or less.

When the metal powder is titanium, such powder is heated in an inert gas atmosphere at a pressure of from $10^{-3}$ bar to $10^{-7}$ bar and a temperature of from about 1800° C. to about 2500° C. The resultant unpassivated powder has a purity of at least as high as the starting powder, a surface area of from about 100 $cm^2/g$ to about 10,000 $cm^2/g$, an oxygen content of 10 ppm or less and a hydrogen content of 1 ppm or less.

When the metal powder is zirconium, such powder is heated in an inert gas atmosphere at a pressure of from $10^{-3}$ bar to $10^{-7}$ bar and a temperature of from about 2300° C. to about 2900° C. The resultant unpassivated powder has a purity of at least as high as the starting powder, a surface area of from about 100 $cm^2/g$ to about 10,000 $cm^2/g$, an oxygen content of 10 ppm or less and a hydrogen content of 1 ppm or less.

When the metal powder is hafnium, such powder is heated in an inert gas atmosphere at a pressure of from $10^{-3}$ bar to $10^{-7}$ bar and a temperature of from about 2400° C. to about 3200° C. The resultant unpassivated powder has a purity of at least as high as the starting powder, a surface area of from about 100 $cm^2/g$ to about 10,000 $cm^2/g$, an oxygen content of 10 ppm or less and a hydrogen content of 1 ppm or less.

From the kinetic standpoint, it is generally preferable to run the process at the temperatures above the melting point of the particular metal as both chemical and diffusion processes proceed at a higher rate in the molten state. The temperature of the system should not be too high in order to minimize the evaporation of the particular metal.

The range of temperatures described above can usually be reached using the gas plasma process. The temperature in the plasma flame is not constant; due to the particle size distribution, it may not be possible to heat all particles to the set temperature. Since the residence time in the plasma flame is extremely short, the particles inherently will be at different temperatures. Therefore, there is a potential to underheat the coarse particles (not enough volatilization) and overheat the fine particles (excessive volatilization, not only of the metal oxide but also the metal itself). It is, however, not the only means of reaching the desired temperature range. For example, the induction melting can be also used.

The requirements of temperature and pressure can be met by using vacuum plasma technique, or other equipment such as electric-resistant furnace, rotary kiln, induction furnace, e-beam furnace in high vacuum and the like. The equipment that is preferable is one that is capable of vacuum and allows flexible residence time.

The process of the invention allows for the production of a metal powder with very low oxygen content typical of the consolidated solid metal. This was made, possible due to the application of the process requiring no reducing agent. The prior art used either magnesium or hydrogen for the reduction of oxygen and therefore, the product (powder) had to be passivated (exposed to air) prior to its further usage.

Processing metal powders under the conditions described has the additional advantage of significantly reducing and/or removing any metallic impurities having boiling points lower than that which the oxide of the metal powder becomes thermodynamically unstable (e.g., depending upon the starting metal powder, such impurities as iron, nickel, chromium, sodium, boron, phosphorous, nitrogen and hydrogen may be significantly reduced). In the case of tantalum, the nitrogen content will be reduced to 20 ppm or less and the phosphorous content will be reduced to 10 ppm or less. Another reaction that will occur under these conditions would be the removal of carbon due to the reaction of the carbide with the oxide. This is particularly important in the case of tungsten, even small amounts of oxygen and carbon can make the tungsten brittle. It is critical to reduce carbon (to a level of 5 ppm or less) and oxygen (to a level of 5 ppm or less) from tungsten to a level at which the tungsten becomes ductile and therefore useable in the cold spray process.

The powder particles produced via the process of the invention have virtually the same low oxygen content regardless of their size. Furthermore, the obtained powder has this low oxygen content regardless of its surface area. Depending on the total pressure, the powder may or may not have to be melted. The powder may be used as a raw material for the ensuing operations without removal of either fine or coarse fraction. Powder can be produced in different types of furnaces including but not limited to plasma, induction, or any resistance furnace capable of working under vacuum.

The process of the invention is a relatively low cost process since it does not require any reducing agent, is a one step process, does not call for the product passivation, does not require screening out powder fractions, and could be run continuously. Moreover, due to the low oxygen and other impurities content, the obtained powder will be of superior grade quality.

Due to the extremely high reactivity of the powder in air, its transfer and further treatment or usage has to be done in the inert atmosphere until the powder is fully consolidated. If the final product is to be used in a cold spray process, it is important that the material not be exposed to any oxygen containing atmosphere before it is sprayed. This can be achieved by either storage under vacuum or other inert gas. For the same reason, the use of inert gas during the cold spray process is necessary.

The result of the present invention is the drastic reduction of the oxygen and carbon contents, for example, that would increase the ductility of the previously unusable refractory metals, and make them potentially usable. This would potentially expand the usage of previously high DBTT metals.

The products of the present invention and blends thereof can be used as raw material for the cold spray process for sealing gaps in refractory metal cladding, for producing sputtering targets, for the rejuvenation of used sputtering targets, for the coating of different geometries in electronics, chemical industrial processes, and other market segments and for X-ray anode substrates. The low content of oxygen and other impurities will dramatically improve the consolidation process.

In addition, the products can be used for pressing and sintering of different components, tools and parts. For example, the powders and their blends can be used in both CIP and HIP processes. Low content of oxygen and other impurities will lead to an extremely high sintering activity of the powders. This will allow for the production of sputtering targets with the content of oxygen and other impurities comparable to that of the standard rolling process.

The products of the invention could also be used in a cold spray process to produce near net-shape parts.

The drastic decrease of oxygen and other impurities could potentially allow for the production of parts via powder metallurgy processes which will be comparable to those produced via standard melting/rolling techniques.

Although illustrated and described herein with reference to certain specific embodiments, the present invention is not intended to be limited to the details described. Various modifications may be made within the scope and range of equivalents of the claims that follow without departing from the spirit of the invention.

The invention claimed is:

1. A method of producing low-oxygen metal powder, the method comprising:

heating a metal powder comprising 50 ppm to 3000 ppm oxygen in an inert hydrogen-free atmosphere to a temperature at which an oxide of the metal powder becomes thermodynamically unstable; and applying a pressure within the range of $10^{-7}$ bar to 1 bar, thereby volatilizing the oxygen and forming a low-oxygen metal powder, wherein the low-oxygen metal powder has an oxygen content of 10 ppm or less and a purity at least as high as a purity of the metal powder.

2. The method of claim 1, wherein the metal powder is selected from the group consisting of tantalum, niobium, molybdenum, hafnium, zirconium, titanium, vanadium, rhenium, and tungsten.

3. The method of claim 1, wherein the inert atmosphere comprises at least one of argon, helium, neon, krypton, or xenon.

4. The method of claim 1, wherein the low-oxygen metal powder has a hydrogen content of 1 ppm or less, a magnesium content of 1 ppm or less, and an alkali metal content of 1 ppm or less.

5. The method of claim 1, wherein heating the metal powder comprises gas-plasma heating, induction heating, or resistance heating.

6. The method of claim 1, wherein a surface area of the low-oxygen metal powder ranges from approximately 100 $cm^2/g$ to approximately 10,000 $cm^2/g$.

7. The method of claim 1, wherein the inert hydrogen-free atmosphere is substantially free of magnesium.

8. The method of claim 1, further comprising, after forming the low-oxygen metal powder, spray depositing the low-oxygen metal powder without passivating the low-oxygen metal powder therebetween.

9. The method of claim 8, wherein spray depositing comprises cold spray.

10. A method of producing low-oxygen tantalum powder, the method comprising:

heating a tantalum powder comprising 50 ppm to 3000 ppm oxygen to a temperature at which an oxide of the tantalum powder becomes thermodynamically unstable; and applying a pressure within the range of $10^{-7}$ bar to 1 bar, thereby volatilizing the oxygen and forming a low-oxygen tantalum powder, wherein the low-oxygen tantalum powder has an oxygen content of 10 ppm or less and a purity at least as high as a purity of the tantalum powder.

11. The method of claim 10, wherein heating the tantalum powder comprises gas-plasma heating, induction heating, or resistance heating.

12. The method of claim 10, wherein a surface area of the low-oxygen tantalum powder ranges from approximately 100 $cm^2/g$ to approximately 10,000 $cm^2/g$.

13. The method of claim 10, wherein the tantalum powder is heated in an ambient substantially free of magnesium.

14. The method of claim 10, further comprising, after forming the low-oxygen tantalum powder, spray depositing the low-oxygen tantalum powder without passivating the low-oxygen tantalum powder therebetween.

15. The method of claim 14, wherein spray depositing comprises cold spray.

16. A method of producing low-oxygen metal powder, the method comprising:

heating a metal powder comprising 50 ppm to 3000 ppm oxygen to a temperature at which an oxide of the metal powder becomes thermodynamically unstable, the metal powder being selected from the group consisting of tantalum, niobium, molybdenum, hafnium, zirconium, titanium, vanadium, rhenium, and tungsten; and applying a pressure within the range of $10^{-7}$ bar to 1 bar, thereby volatilizing the oxygen and forming a low-oxygen metal powder, wherein the low-oxygen metal powder has an oxygen content of 10 ppm or less, a purity at least as high as a purity of the metal powder, a hydrogen content of 1 ppm or less, a magnesium content of 1 ppm or less, and an alkali metal content of 1 ppm or less.

17. The method of claim 16, wherein heating the metal powder comprises gas-plasma heating, induction heating, or resistance heating.

18. The method of claim 16, wherein a surface area of the low-oxygen metal powder ranges from approximately 100 $cm^2/g$ to approximately 10,000 $cm^2/g$.

19. The method of claim 16, wherein the metal powder is heated in an ambient substantially free of magnesium.

20. The method of claim 16, further comprising, after forming the low-oxygen metal powder, spray depositing the low-oxygen metal powder without passivating the low-oxygen metal powder therebetween.

21. The method of claim 20, wherein spray depositing comprises cold spray.

22. A method of producing low-oxygen metal powder, the method comprising:

heating a metal powder comprising 50 ppm to 3000 ppm oxygen to a temperature at which an oxide of the metal powder becomes thermodynamically unstable but below a melting point of the metal powder; and applying a pressure within the range of $10^{-7}$ bar to 1 bar, thereby volatilizing the oxygen and forming a low-oxygen metal powder, wherein the low-oxygen metal powder has an oxygen content of 10 ppm or less and a purity at least as high as a purity of the metal powder.

23. The method of claim 22, wherein the metal powder is heated in an inert atmosphere substantially free of hydrogen and magnesium.

24. The method of claim 22, wherein the metal powder is selected from the group consisting of tantalum, niobium, molybdenum, hafnium, zirconium, titanium, vanadium, rhenium, and tungsten.

25. The method of claim 23, wherein the inert atmosphere comprises at least one of argon, helium, neon, krypton, or xenon.

26. The method of claim 22, wherein the low-oxygen metal powder has a hydrogen content of 1 ppm or less, a magnesium content of 1 ppm or less, and an alkali metal content of 1 ppm or less.

27. The method of claim 22, wherein heating the metal powder comprises gas-plasma heating, induction heating, or resistance heating.

28. The method of claim 22, wherein a surface area of the low-oxygen metal powder ranges from approximately 100 $cm^2/g$ to approximately 10,000 $cm^2/g$.

29. The method of claim 22, further comprising, after forming the low-oxygen metal powder, spray depositing the low-oxygen metal powder without passivating the low-oxygen metal powder therebetween.

30. The method of claim 29, wherein spray depositing comprises cold spray.

* * * * *